US006598586B2

(12) United States Patent
Deschamps et al.

(10) Patent No.: US 6,598,586 B2
(45) Date of Patent: Jul. 29, 2003

(54) DUAL ARM CHOKE AND THROTTLE CONTROL

(75) Inventors: Joseph P. Deschamps, Franklin, TN (US); Doyle S. Maxwell, Greenbrier, TN (US)

(73) Assignee: Murray, Inc., Brentwood, TN (US)

( * ) Notice: Subject to any disclaimer, the term of this patent is extended or adjusted under 35 U.S.C. 154(b) by 0 days.

(21) Appl. No.: 10/194,498

(22) Filed: Jul. 13, 2002

(65) Prior Publication Data

US 2003/0029418 A1 Feb. 13, 2003

Related U.S. Application Data

(60) Provisional application No. 60/305,915, filed on Jul. 17, 2001.

(51) Int. Cl.[7] ..... F02D 9/10; F02D 11/04

(52) U.S. Cl. ..... 123/376; 123/179.16

(58) Field of Search ..... 123/376, 400, 123/179.16, 179.18; 261/52

(56) References Cited

U.S. PATENT DOCUMENTS

| | | | | |
|---|---|---|---|---|
| 3,823,700 A | | 7/1974 | Gumtow | 123/119 F |
| 4,517,942 A | | 5/1985 | Pirkey et al. | 123/376 |
| 4,773,371 A | * | 9/1988 | Stenz | 123/376 |
| 4,860,608 A | | 8/1989 | Kobayashi | 74/501.6 |
| 5,069,180 A | | 12/1991 | Schmidt et al. | 123/376 |
| 5,163,401 A | | 11/1992 | Reese | 123/376 |
| 5,611,312 A | * | 3/1997 | Swanson et al. | 123/179.18 |
| 5,927,241 A | * | 7/1999 | Dahlberg et al. | 123/179.18 |
| 6,439,547 B1 | * | 8/2002 | King et al. | 261/52 |
| 6,550,749 B2 | * | 4/2003 | Vick | 261/52 |

* cited by examiner

*Primary Examiner*—Erick Solis
(74) *Attorney, Agent, or Firm*—Kevin E. Joyce

(57) ABSTRACT

A choke and throttle control arrangement for a small engine includes a base plate to which a pair of levers are pivotally joined. One includes a governor spring arm connected to the engine's speed governor, and the other is provided with an arm which serves as a choke actuator. A spring interconnects the two levers to permit them to rotate in unison at low engine speed in response to operator actuation of a throttle control handle. An adjustable stop member is positioned to interrupt the rotation of the governor spring arm when a selected less-than-maximum engine speed is reached. Further throttle control handle advancement permits the choke actuating arm to move to the closed choke position. As the throttle control handle is moved towards a low speed setting, the lever containing the choke actuating arm returns to the position at which the selected less-than-maximum speed was reached. Once reaching that position, both levers move together under the influence of the interconnecting spring as the engine speed is reduced.

7 Claims, 4 Drawing Sheets

DUAL ARM CHOKE AND THROTTLE CONTROL

This application claims the benefit of U.S. Provisional Application No. 60/305,915, filed Jul. 17, 2001.

BACKGROUND OF THE INVENTION

1. Field of the Invention

The present invention relates to a choke and throttle control arrangement for a small engine.

2. Prior Art

Small engines typically are used with such products as lawn tractors, lawnmowers, snow throwers and the like. Typically, a throttle control handle is provided for operator actuation. The handle is linked to the engine's throttle and its choke.

A commonly used arrangement for joining a throttle control handle to the throttle and choke is a single lever to which the throttle and choke are joined whereby when the throttle handle is advanced from a low speed position, the throttle is displaced towards a full speed position. Advancement of the throttle control handle beyond the full speed position causes closure of the choke.

There are circumstances in which full engine speed cannot be tolerated. In such situations, an arrangement of the type just described does not permit the choke to be closed without the use of additional components, which typically are difficult to install and calibrate so as to achieve desired engine performance. Such a known arrangement will be described more specifically hereinafter.

SUMMARY OF THE INVENTION

The present invention constitutes an improvement over arrangements previously used. A throttle control handle is joined to a pair of levers, one linked to the engine's choke and the other to the throttle. An adjustable stop member is positioned in the path of movement of the throttle lever. The stop member is adjusted so as to permit the associated arm to move in response to the operator's advancement of the throttle control handle until the desired engine speed is reached. At that point, further advancement of the throttle lever is prevented by the stop member. As the throttle control handle advances, the choke lever also is displaced. When the selected engine speed is reached, further advancement of the handle by the operator results in continued displacement of the choke lever until the choke is closed. To open the choke, the direction of movement of the throttle control handle is reversed, and the choke lever is moved in a direction to open the choke. When the handle is moved past the position at which the desired engine speed occurs, the throttle and choke levers again begin to move in unison as the engine speed is reduced.

BRIEF DESCRIPTION OF THE DRAWINGS

The invention now will be described in detail with reference to the accompanying drawings, wherein.

DETAILED DESCRIPTION OF A PREFERRED EMBODIMENT OF THE INVENTION

Figure 1:
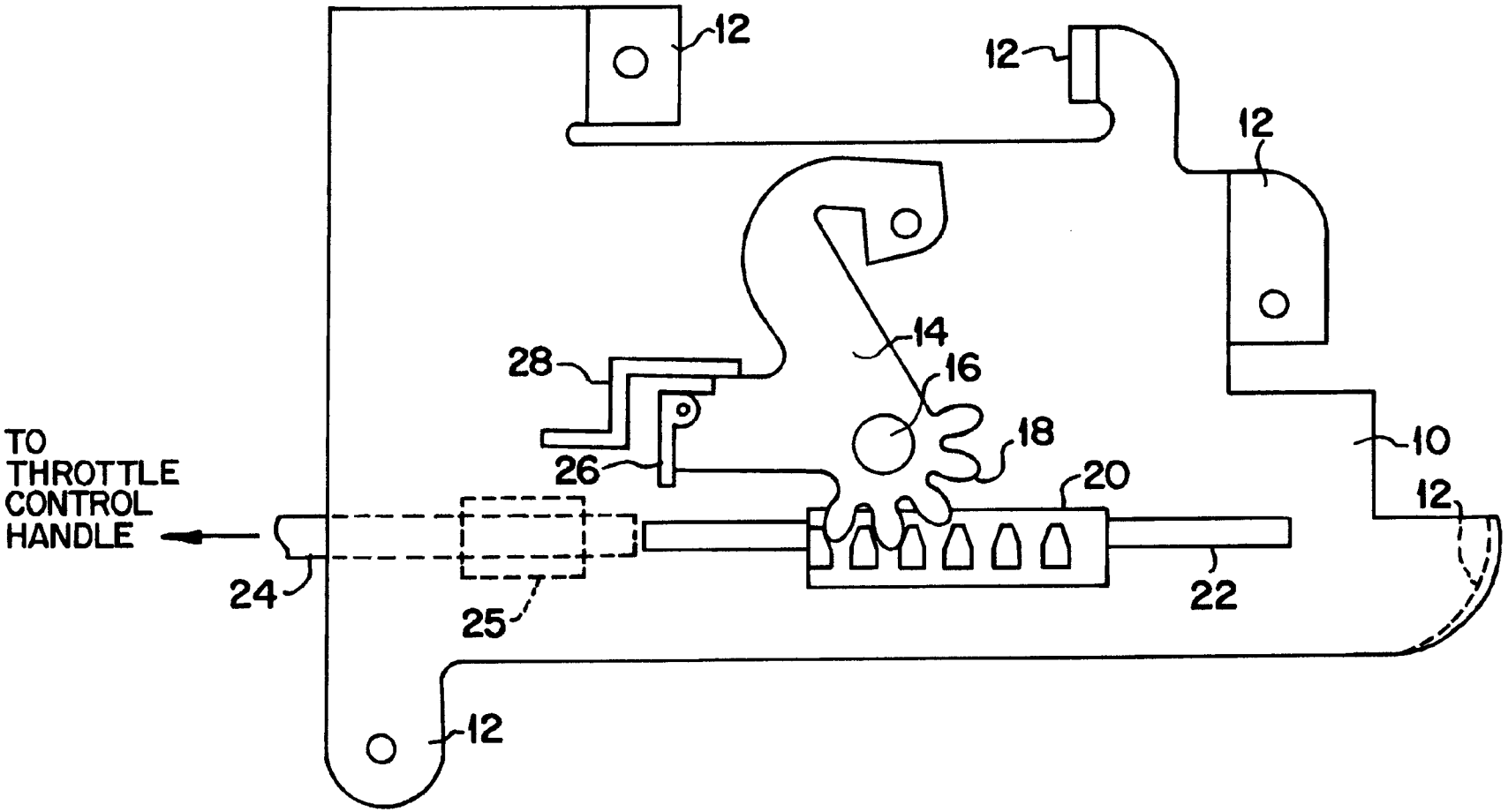
FIG. 1 (PRIOR ART)
FIG. 1 illustrates a choke and throttle control arrangement of the type known in the art.

The invention can best be understood by first describing the prior art arrangement illustrated in FIG. 1. More specifically, a base plate 10 is provided with a plurality of mounting tabs 12 which permit the plate to be secured to a lawn tractor, lawnmower, snow thrower or the like in a position adjacent to an engine (not shown). A lever 14 is pivotally joined to plate 10 at 16. Lever 14 is formed, at an end adjacent pivot 16, with teeth 18. The teeth engage a rack 20 slidably mounted within a slot 22 provided in the plate. The rack is moved along rack 22 in response to operator actuation of a Bowden cable 24 by means a throttle control handle (not shown), the cable being connected at one end to the rack and at its opposite end to the handle. As the rack moves back and forth along slot 22 in response to actuation of the throttle control handle, lever 14 is displaced about its pivot 16.

The lever 14 also is formed to include projections which include a governor spring arm 26 and a choke arm 28. The free end of the governor spring arm 26 is joined to an engine governor (not shown) by a spring (also not shown) so that the engine will operate at a speed established by the position of arm 26. Between low and high speed positions of the throttle control handle, the engine speed is varied in proportion to the position of arm 26.

When the engine is at maximum speed, the governor spring arm 26 is in a substantially vertical position with the governor spring being positioned such that it is stretched to a degree which is only minimally increased as the lever 14 is further pivoted to a position at which the choke arm 28 closes the engine's choke.

If conditions require that the engine speed be limited to less than its maximum speed, the lever 14 is pivoted by an insufficient amount to permit the choke arm 28 from reaching a position where it can close the choke. This occurs when the Bowden cable is relocated within a clamp 25 to a position which prevents lever 14 from being pivoted beyond a position at which the desired less-than-maximum engine speed is reached. When in such a mode of operation, choke operation is achieved by installing a clip to lever 14 to activate the choke when the desired reduced engine speed is reached. However, because of inaccuracies which may result from hysteresis in the Bowden cable and variations which can occur in clamping the Bowden cable and adding a clip to the lever 14, the accuracy of reduced engine speed operation in known arrangements is diminished.

Figure 2:
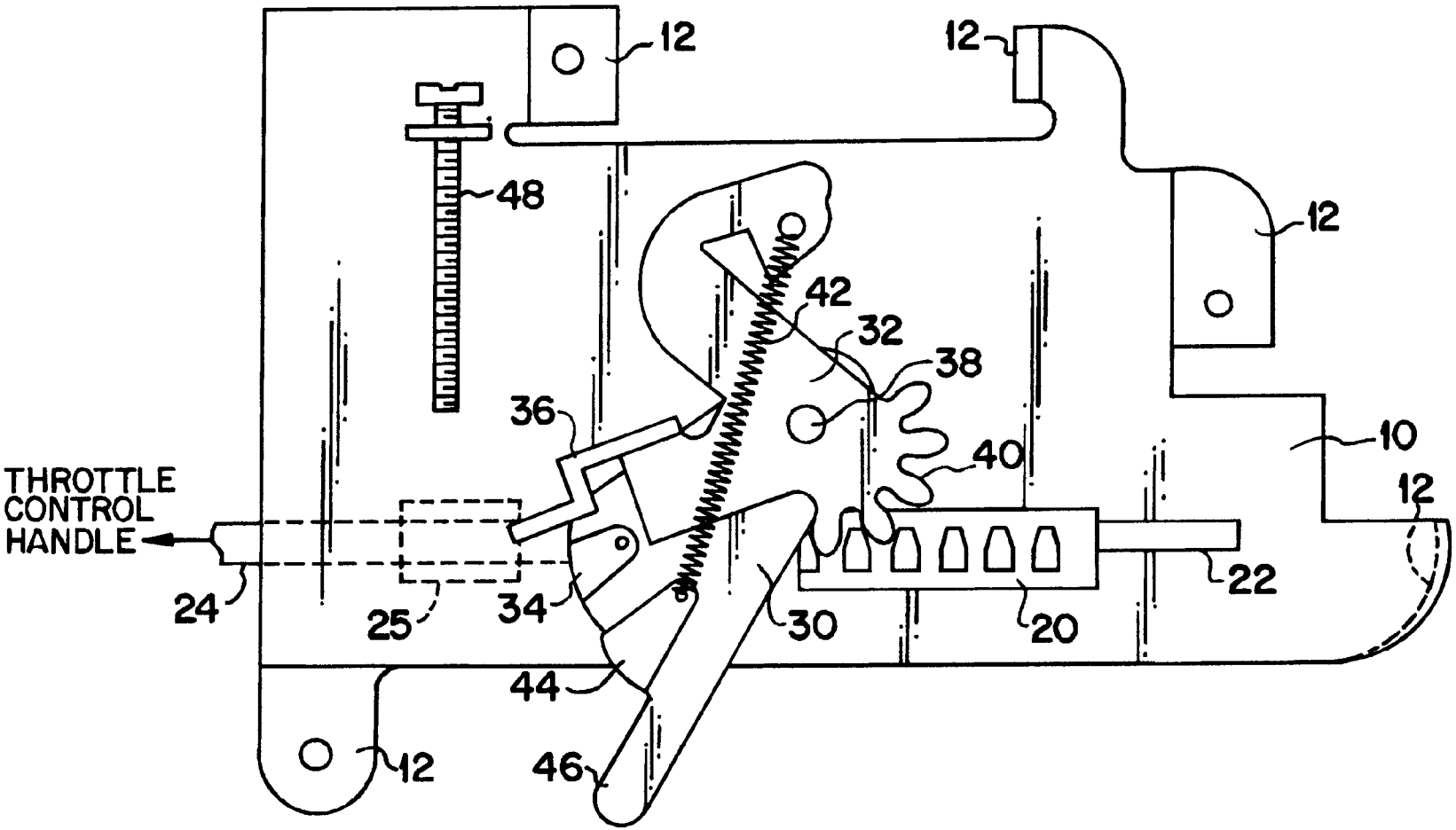
FIG. 2 illustrates a choke and throttle control arrangement according to the present invention, the arrangement being illustrated in a low speed position.
Figure 3:
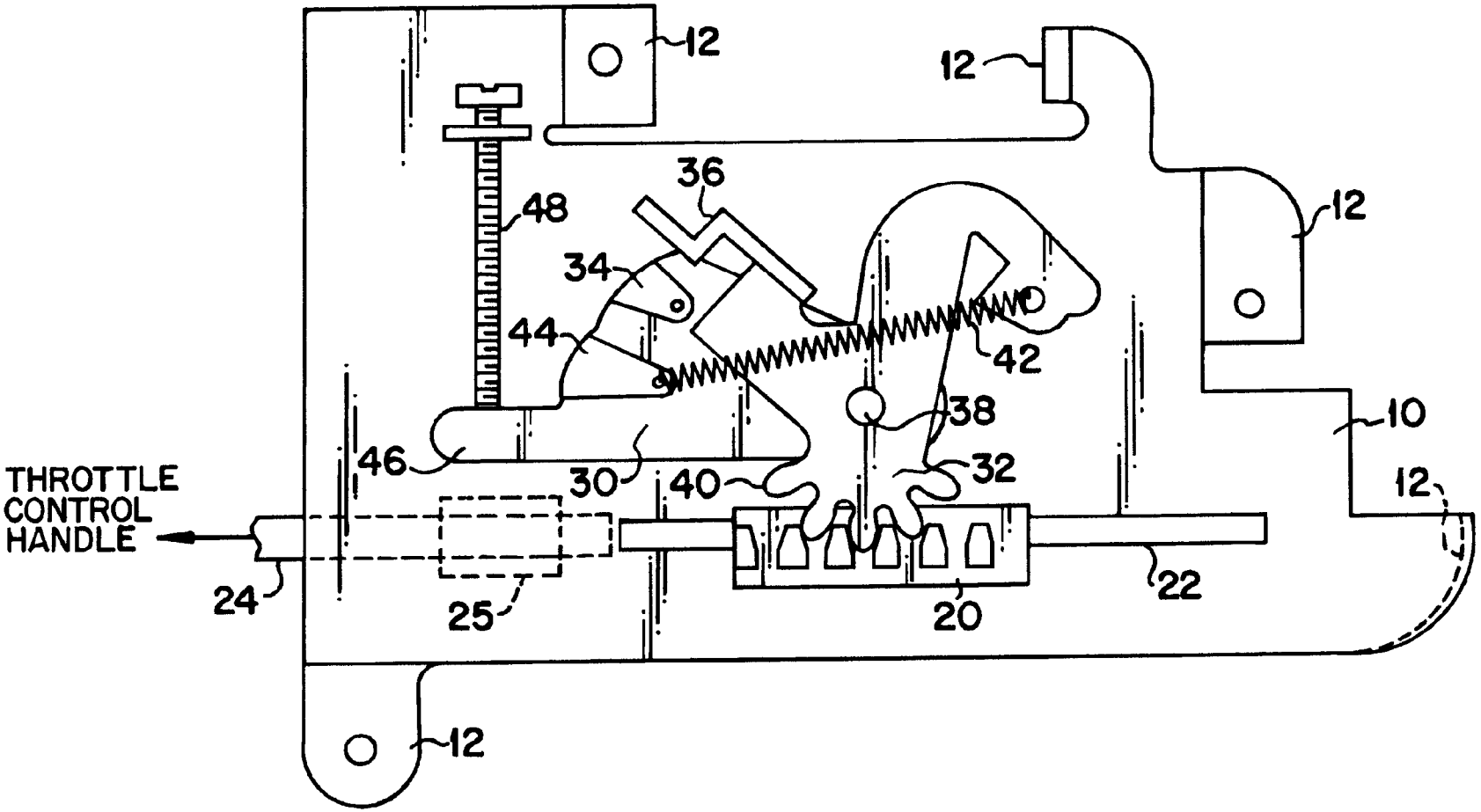
FIG. 3 illustrates the arrangement shown in FIG. 2, the arrangement being shown in the position at which the desired speed of the engine is reached.
Figure 4:
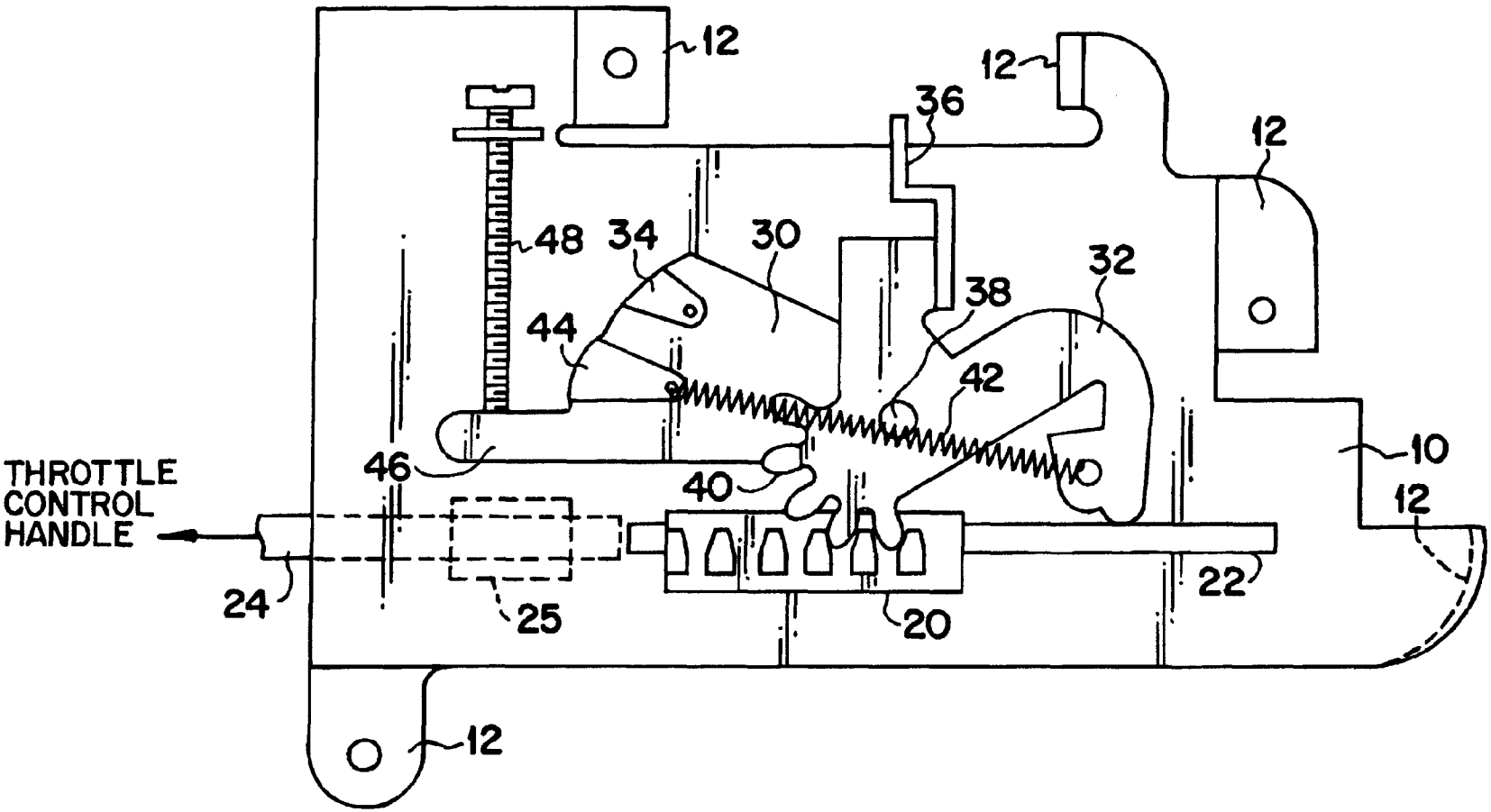
FIG. 4 illustrates the control arrangement of FIG. 2, the arrangement being shown in the position at which the choke is closed.

The present invention overcomes the deficiencies of the prior art utilizing an arrangement illustrated in FIGS. 2–4. The fundamental difference between the prior art arrangement and that shown in FIGS. 2–4 is that instead of the single lever 14 used in the FIG. 1 arrangement, a pair of levers 30 and 32 are employed. The levers are formed, respectively, to include a governor spring arm 34 and a choke arm 36. Levers 30 and 32 are commonly pivoted to base plate 10 at 38. It will be understood, however, that it is possible for the levers to be separately pivoted to plate 10.

Lever 32 also is formed to include teeth 40 at one of its ends. As in the case of the prior art arrangement previously described, teeth 40 are positioned to interact with a rack 20 which is slidable within a slot 22 provided in plate 10, the rack being displaced by a Bowden cable 24 when a throttle control handle is operator actuated so as to pivot lever 32.

Levers 30 and 32 are interconnected by a spring 42 extending between an end of lever 32 opposite teeth 40 and a tab 44 provided on lever 30. During low speed actuation of the throttle control handle (FIG. 2), the spring causes lever 30 to rotate in unison with the lever 32 as the latter is rotated in response to throttle control handle movement.

Lever 30 also is formed to include a projecting detent 46. An adjustable stop member 48 is secured to the base plate 10. In the embodiment illustrated, the stop member is a threaded screw which can be adjustably positioned within the path of movement of the detent 46.

As the lever 30 rotates when the engine speed advances from a low speed, detent 46 comes into contact with the stop member 48 at a pre-selected position (FIG. 3) which establishes the highest speed at which the engine is permitted to operate. This speed is not exceeded even if the throttle control handle is further advanced to its normal full speed position.

When the throttle control handle is advanced beyond the point that detent 46 reaches the adjustable stop member 48, the force of spring 42 is overcome, and lever 32 continues to rotate about pivot 38 independently of the stopped lever 30, but without a change in engine speed. As a result, the choke control arm 36 is permitted to move past the normal full engine speed position to a location (FIG. 4) at which the arm closes the choke.

The engine normally is started in a closed choke position. After the engine is started, movement of the throttle control handle causes lever 32 to rotate about pivot 38 from the position shown in FIG. 4 to that illustrated in FIG. 3. When the latter position is reached, the engine operates in an open choke condition at a speed established by the contact between detent 46 and the adjustable stop member 48. When the throttle control handle is moved to reduce the engine speed, spring 42 causes levers 30 and 32 to move simultaneously towards the position shown in FIG. 2.

In the embodiment described above, an adjustable screw has been illustrated as the stop member. It will be understood, however, that other adjustable stop arrangements can be employed, such as a bendable tab on the governor spring arm 34 and a fixed stop associated with plate 10. Additionally, the spring 42 may be a torsion spring instead of the extension spring illustrated.

The device described with respect to FIGS. 2–4 can be converted to one in which full engine speed is permitted. This is accomplished by removal of stop member 48. Without the stop member, levers 30 and 32 can move together through the entire speed range.

What is claimed is:

1. An engine choke and throttle control arrangement of the type in which an operator acutated throttle control handle is linked to a speed governor spring arm and to a choke arm, the arrangement comprising:

a base plate;

a first lever pivotally connected to the base plate and including said governor spring arm;

a second lever pivotally connected to the base plate and including said choke arm;

a spring extending between said first and second levers;

a linkage joining the throttle control handle to one of said levers for rotating said one lever about its pivotal connection in response to actuation of the throttle control handle, said spring producing simultaneous rotation of the other of said levers when the engine is operating below a predetermined speed;

a stop member positioned to engage a detent formed in the first lever when said first lever is rotated to a position at which said predetermined engine speed is reached, one of said stop member and detent being adjustable to establish the position for obtaining said predetermined speed, and said stop member and detent preventing the predetermined speed from being exceeded; and said spring having a spring force which allows the second lever to rotate about its pivotal connection, independently of the first lever, when the throttle control handle actuation is greater than that required to move the stop member into engagement with the detent, whereby the choke arm is permitted to function when the engine is operating at said predetermined speed.

2. An arrangement according to claim 1, herein said first and second levers have a common pivotal connection to the base plate.

3. An arrangement according to claim 1, wherein said linkage joins the throttle control handle to said second lever.

4. An arrangement according to claim 1, wherein said linkage includes a Bowden cable connecting the throttle control handle to a rack slidable within a slot in the base plate, said one lever including teeth engaging the rack for rotating said one lever when the throttle control handle is actuated.

5. An arrangement according to claim 4, wherein said one lever is the second lever.

6. An arrangement according to claim 5, wherein said first and second levers have a common pivotal connection to the base plate.

7. An arrangement according to claim 1, wherein said stop member is an adjustable screw mounted on the base plate.

* * * * *